United States Patent [19]

Viramontes

[11] 4,412,677

[45] Nov. 1, 1983

[54] PORTABLE EXERCISE APPARATUS

[76] Inventor: Michael B. Viramontes, 142 Princeton, Vallejo, Calif. 94590

[21] Appl. No.: 352,253

[22] Filed: Feb. 25, 1982

[51] Int. Cl.[3] ..... A63B 1/00

[52] U.S. Cl. ..... 272/62; 211/117; 182/206

[58] Field of Search ..... 272/62, 900; 211/105.1, 211/113, 117, 123, 124; 182/53, 54, 55, 57, 58, 59, 60, 61, 206, 230, 214; D12/155; D25/64

[56] References Cited

U.S. PATENT DOCUMENTS

| | | | |
|---|---|---|---|
| D. 179,748 | 2/1957 | Tunstead | 182/206 X |
| D. 193,890 | 10/1962 | Canning et al. | 182/206 UX |
| D. 242,254 | 11/1976 | Bernkrant | D25/64 |
| 2,193,215 | 3/1940 | Witter | 211/117 X |
| 2,758,770 | 8/1956 | Wagner | 182/206 |
| 3,042,143 | 7/1962 | Silen | 182/206 X |
| 3,056,466 | 10/1962 | Wall, Jr. | 182/214 |
| 3,078,955 | 2/1963 | Rich | 182/214 X |

FOREIGN PATENT DOCUMENTS

| | | | |
|---|---|---|---|
| 819360 | 9/1959 | United Kingdom | 272/62 |
| 894993 | 4/1962 | United Kingdom | 182/206 |

*Primary Examiner*—Robert A. Hafer
*Assistant Examiner*—Arnold W. Kramer
*Attorney, Agent, or Firm*—Melvin R. Stidham

[57] ABSTRACT

A portable chinning apparatus comprising a horizontal chinning bar interconnecting two posts of adjustable length. The posts are suspended from a pair of inverted U-shape brackets which fit snugly over a length of nominal two inch lumber as in a garage rafter.

3 Claims, 1 Drawing Figure

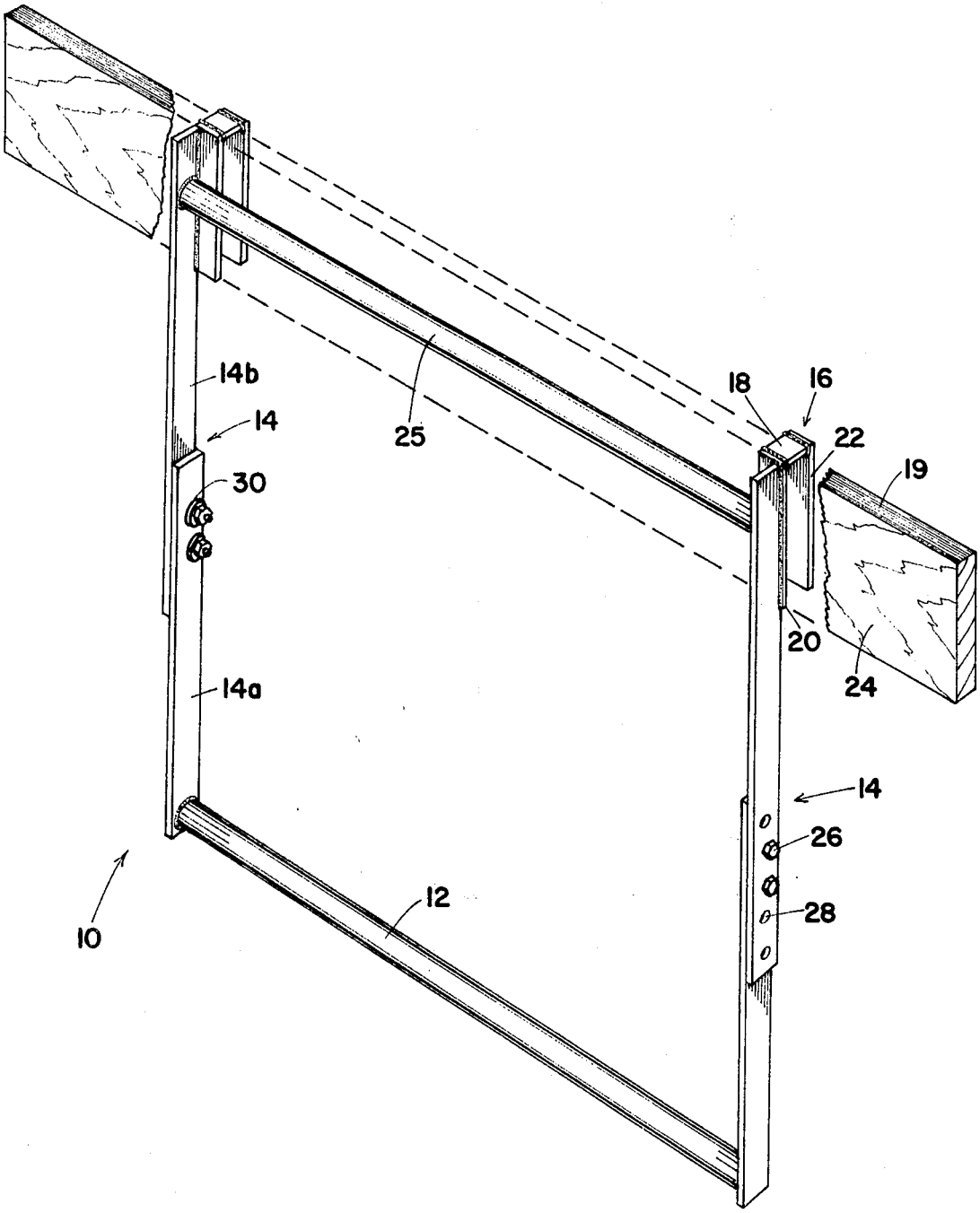
14b
14
30
14a
25
18
16
22
19
20
24
14
26
28
12
10

PORTABLE EXERCISE APPARATUS

BACKGROUND OF THE INVENTION

Particularly with the recent emphasis on improved physical conditioning, there is an increased demand for exercise equipment that can be set up and used in one's home. As a result, there is a multitude of exercising devices on the market, but most require a substantial amount of floor space, and many are priced at levels that make them prohibitive for the typical wage earner.

OBJECTS OF THE INVENTION

It is an object of this invention to provide a portable exercise apparatus that can be manufactured and sold at a price affordable by most, and which can be easily assembled and installed.

It is a further object of this invention to provide a chinning bar that is adapted for instant installation and use in a garage or any portion of a building with exposed beams or rafters.

Other objects and advantages of this invention will become apparent from the description to follow, particularly when read in conjunction with the accompanying drawing.

SUMMARY OF THE INVENTION

In carrying out this invention, I provide a chinning bar that extends between the lower ends of a pair of posts. Secured to the upper ends of the posts are mounting brackets of inverted U-shaped configuration that slip snugly over a length of nominal two inch lumber, such as a two by four or two by six overhead rafter in a garage. The length of the posts may be adjusted to accommodate people of different heights and to provide sufficient head room for normal use of the building or room in which it is located.

BRIEF DESCRIPTION OF THE DRAWING

The drawing is a view in perpsective showing the portable chinning bar of this invention.

DESCRIPTION OF A PREFERRED EMBODIMENT

Referring to the drawing with greater particularity, the portable chinning apparatus of this invention 10 comprises a bar 12, preferably of circular configuration, such as a length of ¾ inch pipe, which is secured to and interconnects the lower ends of a pair of depending posts 14. Secured to the top of each post is a mounting bracket 16 of inverted U-shaped configuration. The mounting brackets may be made of three pieces of flat steel bar stock comprising an intermediate spacer 18, which is the width of nominal two inch lumber, that is to say, two and one-half inches, with depending legs 20 and 22 on opposite sides to engage the faces 24 of the rafter 19 to prevent movement to and fro. The depending legs 20 and 22 should be of sufficient length, say five inches, to provide substantial stability.

A cross member 25 may be secured firmly to the mouting brackets 16 to further rigidify the structure and to facilitate carrying it about.

Preferably, the depending posts 14 are made in two sections **14*a* and 14*b*, which are secured together by bolts 26. A row of holes 28 is provided in one of the sections to be aligned with one or more holes 30 in the other section so that the overall length of the posts 14 may be adjusted. Hence, the exercise apparatus may be adjusted to accommodate people of different heights and, in addition, the post sections 14*a* and 14*b* may be collapsed sufficiently to raise the bar 12 so as not to impeded with normal use of the room in which it is being used. Hence, the apparatus 12** can simply be left in place when not in use and automobiles may occupy the garage and people move about it without interference.

While this invention has been described in conjunction with a preferred embodiment thereof, it is obvious that modification and changes therein may be made by those skilled in the art to which it pertains without departing from the spirit and scope of this invention, as defined by the claims appended hereto.

What is claimed as the invention is:

1. A portable chinning apparatus comprising:

a pair of vertical posts;

a bar interconnecting said posts near the lower ends thereof;

a pair of mounting brackets, of flat steel bar stock, each of inverted U-shaped configuration including a flat horizontal top bar and parallel vertical bars at least three inches long depending therefrom and spaced to slide snugly down over a wooden rafter of nominal two inch thickness; and means securing said posts to said brackets to be suspended therefrom;

said posts being free of lateral extensions for engagement with a vertical wall.

2. The chinning apparatus defined by claim 1 wherein:

said posts are formed in two sections;

and including:

releasable means securing said sections together to adjust the total length of said posts.

3. The chinning apparatus defined by claim 1 including:

a cross bar secured to and interconnecting said mounting brackets.

* * * * *